United States Patent [19]

Schultz

[11] 4,098,181

[45] Jul. 4, 1978

[54] DISPOSAL INSTALLATION FOR DOMESTIC WASTE

[76] Inventor: Eduard August Schultz, 291, Engelandlaan, Haarlem, Netherlands

[21] Appl. No.: 722,285

[22] Filed: Sep. 10, 1976

[30] Foreign Application Priority Data

Sep. 12, 1975 [NL] Netherlands ..... 7510762

[51] Int. Cl.[2] ..... B30B 1/18; B30B 7/00

[52] U.S. Cl. ..... 100/102; 100/DIG. 2; 100/208; 100/218; 100/245; 100/289; 241/23; 241/73; 241/75; 241/99; 241/101.2; 241/144

[58] Field of Search ..... 241/99, 101.2, 75, 134, 241/138, 73, 23, DIG. 38, 242, 222, 144; 100/245, 289, 218, DIG. 2, 102, 94, 208, 176

[56] References Cited

U.S. PATENT DOCUMENTS

| | | | |
|---|---|---|---|
| 167,268 | 8/1875 | O'Connor | 100/208 |
| 1,125,451 | 1/1915 | Bottomley | 100/208 |
| 1,847,990 | 3/1932 | Stoner | 241/73 |
| 2,171,949 | 9/1939 | Roca | 241/73 |
| 2,213,445 | 9/1940 | Marsh | 241/144 |
| 2,800,159 | 7/1957 | Walsh | 100/DIG. 2 |
| 3,104,607 | 9/1963 | Galas | 100/DIG. 2 |
| 3,204,550 | 9/1965 | Swiderski | 100/DIG. 2 |
| 3,232,220 | 2/1966 | Sileski | 241/99 |
| 3,249,040 | 5/1966 | van der Lely | 100/245 |
| 3,790,093 | 2/1974 | McIntyre | 241/73 |
| 3,807,296 | 4/1974 | Eck | 100/102 |
| 3,871,291 | 3/1975 | Lassiter | 241/23 |
| 3,960,334 | 6/1976 | Wudyka | 241/73 |

FOREIGN PATENT DOCUMENTS

| | | | |
|---|---|---|---|
| 1,507,471 | 4/1969 | Fed. Rep. of Germany | 241/101.2 |

*Primary Examiner*—Billy J. Wilhite
*Attorney, Agent, or Firm*—Karl W. Flocks

[57] ABSTRACT

Disposal installation for domestic waste, to be used e.g. in or near kitchens of houses, hotels and the like, whereby the installation comprises a common holder, in which four separate and separated chutes are accommodated, which are meant for the disposal of respectively tins, glass, synthetic material and food remains, and whereby in each chute waste processing devices are accomodated, which reduce and process the waste meant for the chute.

2 Claims, 5 Drawing Figures

DISPOSAL INSTALLATION FOR DOMESTIC WASTE

The invention relates to a disposal installation for domestic waste, to be used e.g. in or near kitchens of houses, hotels and the like.

So far, domestic waste used to be deposited directly or through chutes into bins or sacks, which are subsequently transported to dumps. This waste usually is unsorted and difficult to process, as sorting the mixed waste is time-consuming and expensive. From an environmental viewpoint, this is to be regretted, as on the one hand the unprocessed waste accumulates on ever growing dumps, which are undesirable for reasons of space and also of hygiene. Attempts have been made to solve this problem by waste combustion, but this presents the disadvantage of pollution by combustion gases, whereas much material is lost which could be recycled. Further, there are compost plants, which process waste into compost by a putrefaction process. A disadvantage thereof is that the waste contains many remains which cannot be broken down, such as glass, tins and especially synthetic material, which cannot be converted at all.

Starting from the fact that many useful materials are contained in the waste, it would be preferable that the different types thereof could be sorted out and processed separately. As said above, this cannot be achieved very well, since the cost involved would be very high.

It is the aim of the present invention to solve this problem in an efficient and simple way. The basic idea thereof is that each sorting of materials can be done best and at the lowest cost at the source, in this case the household, where the waste originates. Domestic waste can in principle be divided into four main groups, namely tins, glass synthetic materials and food remains. For the housewife, respectively the kitchen personnel in case of a hotel or hospital, it takes relatively little time to sort the waste beforing throwing it away, provided the opportunity exists. It is indeed easy to dispose of an empty food tin separately from food remains, and the same applies to glass and synthetic materials. If the willingness exists with the housewives, respectively the kitchen or other personnel, to do this sorting, and if the means are present to make such a sorting possible, the problem of the unsorted waste is solved completely and this waste can be processed in a useful way.

A disadvantage, however, is that the separate disposal of said four main waste products takes rather much space. It is therefore necessary to give this waste beforehand such a shape that it can be stored and transported compactly. In order to reach these goals, the invention proposes a domestic waste disposal installation, which comprises a common holder, in which four separate chutes are accommodated for the disposal of respectively tins, glass, synthetic material and food remains, in each of which chutes waste processing devices are provided which reduce the size and process the waste destined for that chute.

At the output side, the waste conveyed and reduced by each chute is received in a waste container or sack meant specially for this type of waste, which can then be collected by municipal cleaning services and transported to sorting departments where this sorted and reduced waste can be stored compactly and further processed. The crushed glass can be transported to the glass industry, the tin material to suitable metallurgical industries, the reduced synthetic materials can be processed to serve as filling material and the food remains can e.g. be the basis of animal food.

For a practical, efficient embodiment, the size of which can be kept small, it is preferable that in the disposal installation according to the invention the four chutes are essentially parallel, vertical and of rectangular section, that the chute for food remains and the chute for synthetic materials are adjacent to each other and have each a rotating grinder, which have a common rotor shaft or separate rotor shafts in line with each other, which are driven by a common motor, and that the chute for glass and the chute for tins are also adjacent to each other and have each a pressing installation, which pressing installations are also driven by a common motor. In this way the entire installation can be driven by two electromotors, which are operatable separately and of which the power is not so great that it would present an overload to normal households. The operation can take place by means of two switches, one for the motor for the rotating grinders, and one for the motor for the pressing installations. In this way a simply operatable unit is obtained, of which the user only needs to know into which chute which waste is to be deposited.

According to the invention, the embodiment for the disposal of food remains can be so, that the chute for food remains comprises a grinding compartment with a rotor, which can rotate around a horizontal rotation shaft, and which consists of two end discs interconnected by longitudinal edge knives regularly distributed over the circumference of the end discs, which knives cooperate with two oppositely situated fixed knives, arranged in such a way that, when rotating, the cutting edges of the rotating knives subsequently pass closely by the cutting edges of the fixed knives, under the grinding compartment a drying drum being provided, in which the ground food remains are received and dried by means of a drying installation operated by a time switch mechanism, under the drying drum a receiving container being provided, into which fall the ground food remains after the drying in the drying drum. The drying of the ground food presents the advantage that putrefaction is excluded, which, especially when the food remains are stored afterwards, offers a great advantage in connection with the preservability.

In order to achieve an efficient disposal of the synthetic material, the disposal installation according to the invention can further be carried out such, that the chute for the synthetic material comprises a grinding compartment, closed at the under side by a cylindrically bent perforated plate, in which compartment a rotor is accommodated, which can rotate around a horizontal shaft, arranged along the cylinder shaft of the bent plate, which rotor is provided with a number of edge knives regularly distributed over its circumference, which knives cooperate with two oppositely situated fixed edge knives arranged at both sides above the plate in such a way that, when rotating, the cutting edges of the rotating knives pass closely by the cutting edges of the fixed edge knives, so that sufficiently reduced synthetic parts are pressed subsequently through the holes in the perforated plate. The holes in the perforated plate, which acts as a sieve, can be adapted to possible standard requirements.

For crushing glass and tins, the installation according to the invention can finally be carried out such, that in each of the chutes for glass and tins a plate press is provided, consisting of two parallel, vertical press plates, the one of which is fixed to the chute-wall and the second of which is mobile towards and away from the first by means of a jack driven by a threaded shaft, the second plate being guided along two opposite chute-walls by means of a system of bearings and rollers, and that just under the plate press a closing plate is provided which, adjacent and parallel to the fixed plate, has a slot through which crushed glass or flattened tins can fall down.

It is observed that domestic waste reducing installations are known already, in which the waste is ground. However, these known installations do not provide the possiblity of sorted waste, so that the ground waste cannot be processed further in a useful way. Moreover, these known grinding installations require a presorting, which is useless in this case, by the housewife, since they are not suitable for grinding glass and tins, which materials, useful in themselves, end up in the garbage bins without being sorted.

The invention will be explained hereinafter by means of an example of an embodiment, with reference to the drawing, in which:

FIG. 1 shows an open top view of a common holder 1 in which four separate chutes are provided, 2,3,4 and 5 with schematically shown walls, meant respectively for the disposal of food remains, synthetic waste, empty food tins, and empty bottles and the like.

Figure 2:
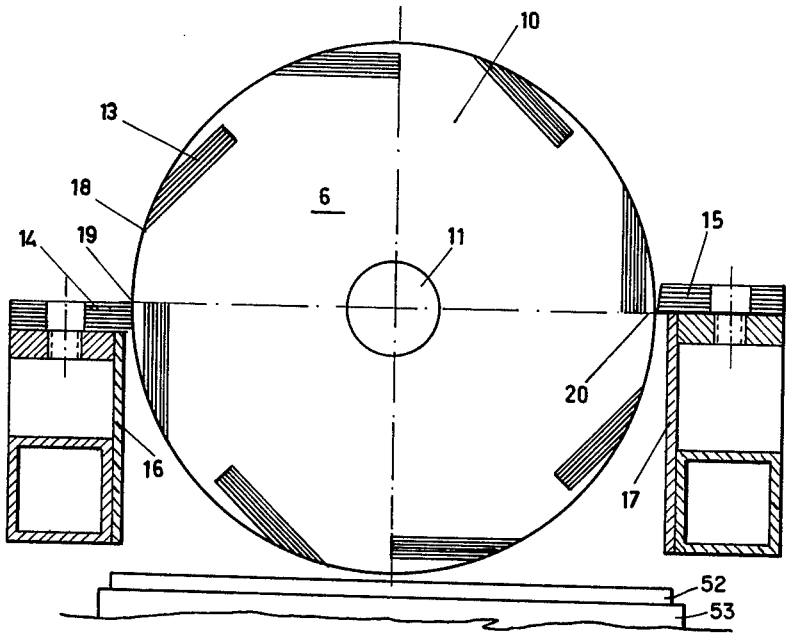
FIG. 2 shows a section of a food remains grinder, which is used in this installation.

The chute 2 for food remains comprises a grinding and drying installation 6, the chute 3 for synthetic materials comprises a grinding installation 7, the chute 4 for tins comprises a tin press 8 and the chute 5 for glass comprises a bottle press 9. The installation 6, 7,8 and 9 will now be explained in detail by means of FIGS. 2, 3,4 and 5. FIG. 2 shows in section the food remains grinder 6, which is accomodated in the chute 2 for food remains. The installation consists of a rotor which is formed by two end discs 10 on which the rotor shaft 11 is provided centrally, which via shaft bearings 12 is guided through two oppositely situated side walls of the chute 2. Between the two rotor discs 10 there are a number of strip-shaped edge knives 13, of which the respective ends are connected with the discs 10. These knives are distributed over the circumference of the discs and are meant to cooperate with two fixed knives 14 and 15, which by means of holding devices 16 and 17 are fixed to two oppositely situated chute side walls, through which the shaft 11 is not bearing-mounted. The fixed edge knives are arranged in such a way that their respective cutting edges 19 and 20 are inverted with respect to each other. The rotor is driven by an electromotor 51 which may have a power of e.g. 3/4 HP and which makes the rotor rotate at a speed of circa 700 rpm. During operation, food remains thrown from above into the chute are finely ground by the fast rotating rotor, in that the cutting edges 18 of the rotating knives 13 subsequently pass closely by the cutting edges 19 and 20 of the fixed knives. The ground food falls down where it can be received in a drying drum 52 and container 53 therebelow, where the further processing, which is not discussed here, can take place.

Figure 1:
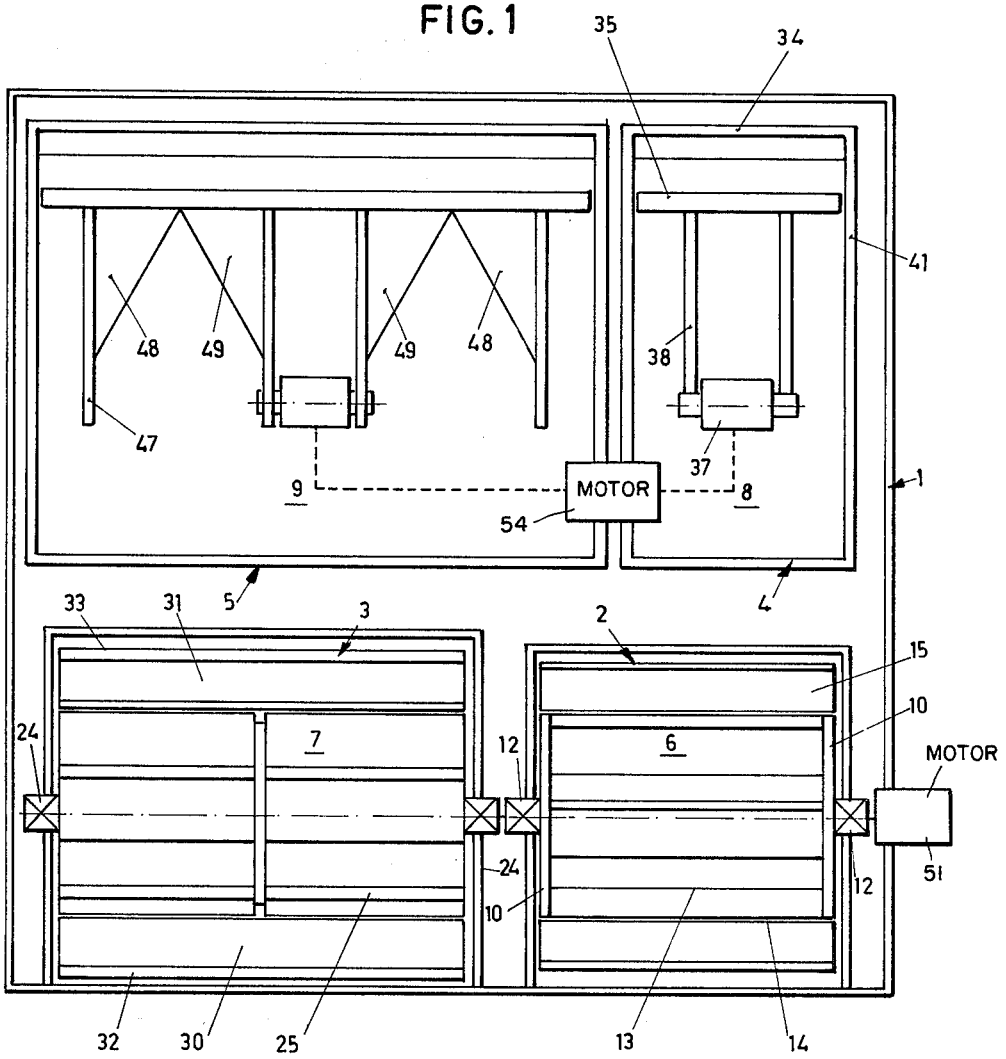
FIG. 1 shows an open top view of an installation according to the invention.
Figure 3:
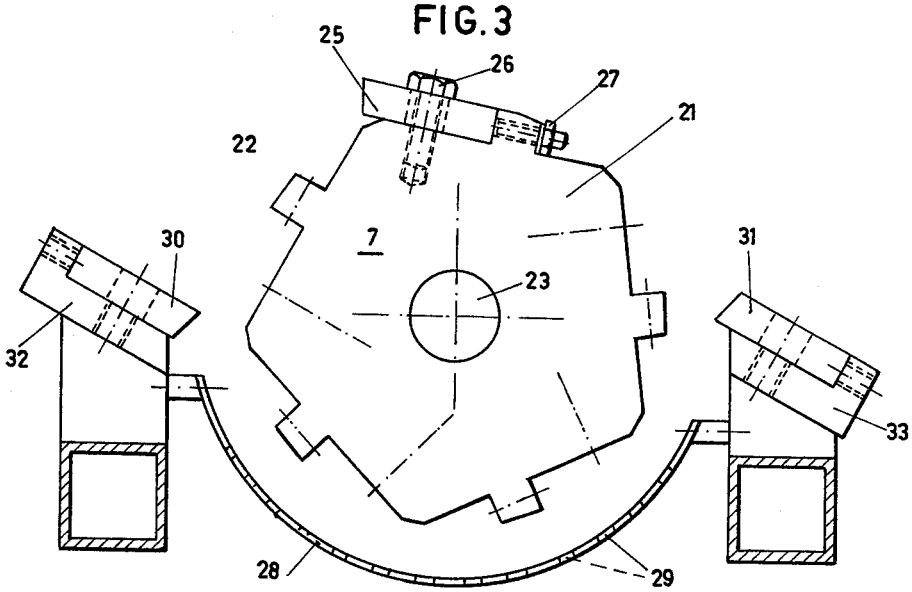
FIG. 3 shows a section of a grinding installation for synthetic materials, which is used in the installation according to FIG. 1.

FIG. 3 shows in section the grinding-, respectively crushing installation 7 for plastic of FIG. 1. In FIG. 3 the grinding installation consists of a pentagonal rotor body 21 which bears cams 22 at its pentagonal surfaces. The rotor body has its central rotor shaft 23, which by a shaft bearing 24 is guided through two oppositely situated side walls of the chute 3. The arrangement is such that the rotor shafts 11 and 23 are in line with each other, in view of the common drive by one and the same electromotor 51. On the rotor body there are five edge knives 25, of which only one is shown. These edge knives are fixed to the respective lateral sides of the pentagonal rotor body by means of holding screws 26, whereas they are also guided with projecting parts by the cams 22. By means of adjusting screws 27 the edge knives can be adjusted. Under the thus assembled rotor there is a cylindrical hollow bottom plate 28 provided with perforations 29. The curve of this bottom plate is such that the shaft thereof coincides with that of the rotor. At both sides above this hollow bottom plate there are two fixed edge knives 30 and 31, which are fixed to the chute by means of holding devices 32, respectively 33. The arrangement of these edge knives is such that their cutting edges are inverted with respect to each other and that, when the rotor rotates, the rotating edge knives 25 pass closely with their cutting edges by the cutting edges of the fixed edge knives. When the synthetic material is thrown from above into the chute 3, it is cut and ground by the cooperation of the rotating knives and the fixed knives. This ground waste is received in the hollow bottom and is pressed down through the perforations. In this way it is assured that a certain degree of fineness is obtained before the synthetic material can be evacuated. As said above, the electromotor for driving the food remains grinder also serves to drive the rotor for the synthetic material.

Figure 4:
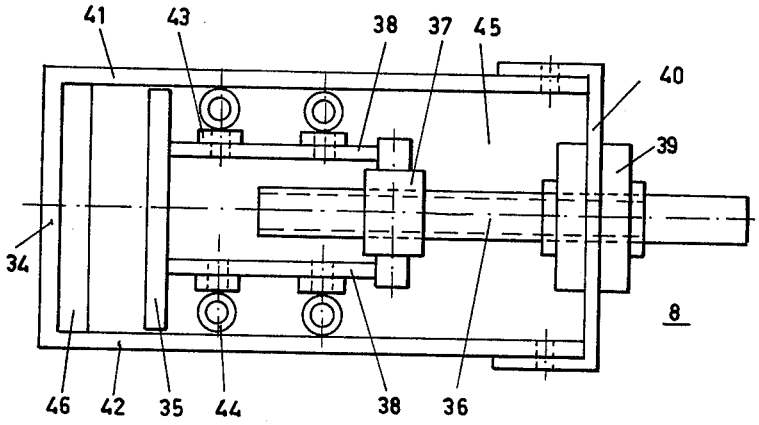
FIG. 4 shows a tin press for flattening empty food tins and the like, and FIG. 5 shows a bottle press, with which bottles and other glass are reduced.

FIG. 4 shows the pressing installation 8, with which empty food tins and the like can be flattened in chute 4. This installation comprises a fixed plate 34, which in the shown example is a part of the chute-wall, and a press plate 35 parallel thereto and mobile with respect thereto, which by means of a jack system can be moved towards and away from the fixed plate 34. This jack system has a jack shaft 36 which is provided at its front side with external thread and which can rotate in a jack nut 37 of which the internal thread corresponds to the external thread of the jack shaft. The jack shaft 36 is guided by a shaft bearing 39 through the chute side wall 40 opposite the fixed plate 34. The jack nut 37 is connected with the mobile press plate 35 by means of two cross parts 38, which are supported against the opposite side walls 41 and 42 of the chute and guided via roller bearings, which are shown schematically by means of supports 43, which are connected with the cross parts 38, and rollers 44, which are supported and can roll against the respective side walls 41 and 42. Under the thus formed plate press there is a closing bottom plate 45 which at the front side, adjacent the parallel to the fixed plate 34, has an evacuation slot 46. In operation, waste such as empty food tins is thrown into the chute 4. After starting the driving motor, an electromotor 54, which rotates the jack shaft alternately in the one and in the other direction, the mobile press plate 35 is moved alternately towards and away from the fixed plate 34, so that the tins between the two plates are flattened. When flattened sufficiently, they fall down through the slot 46, whereas new waste can be received between both plates. In this way empty food tins can be flattened efficiently to such a volume, that a considerable amount of space is saved for possible later storage of this waste material.

Figure 5:
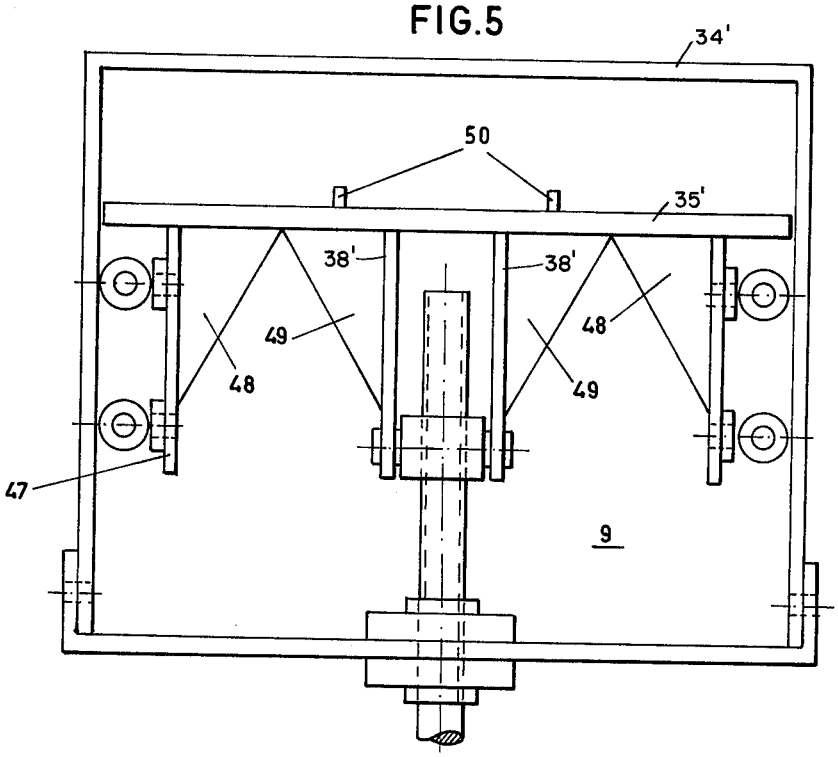

FIG. 5 shows the bottle press 9 which is accommodated in the chute 5 for glass. The bottom press is in principle carried out in the same way as the tin press from FIG. 4. Therefore, corresponding parts are indicated by corresponding reference numbers provided with a prime mark, and for the working of the glass press, reference is made to the tin press from FIG. 4. Moreover, the drive of the bottle press is assured by the same motor 54 that drives the tin press. The difference with the tin press is only that in connection with the dimensions of bottles, the glass press has wider press plates 34' and 35', and that the support of the mobile press plate 35' does not take place directly via the cross parts 38', but via auxiliary cross parts 97, which just like the cross parts 38' are supported in their cross position by means of supports 48, which in cross section have the shape of a rectangular triangle. Corresponding supports 49 assure a similar support of the cross parts 38'.

In order to facilitate the crushing of glass during the move of the mobile plate 35' towards the fixed plate 34', the mobile plate 35' has breaking cams 50 which assure that the glass can be broken more easily there, so that an undesirable overload of the plates and slipping out of the bottles can be prevented.

In the above an example of an embodiment of the installation according to the invention has been discussed. It will be obvious that variations and modifications are possible without leaving the framework of the invention.

I claim:

1. A disposal installation for recycling of domestic waste for use in or near kitchens of houses, hotels and the like, said waste being selectively collected in four different containers and disposal installation comprising in combination, four separate chutes for receiving and holding respectively food remains, synthetic material, tins, and glass for separate recycling;

said four chutes being essentially parallel to each other, vertical, and of rectangular section;

said chute for food remains and said chute for synthetic material being adjacent to each other and each having a rotating grinder, both driven by a common driving means;

said chute for glass and said chute for tins being adjacent to each other and each having a pressing installation, both driven by a common driving means;

said chute for food remains having a drying installation under said grinder in which ground food remains are received and dried for a predetermined time, and a receiving container provided under said drying installation into which fall the ground food remains after drying;

said chute for synthetic material including a grinding compartment, a cylindrically bent perforated plate closing said synthetic material chute grinding compartment at its underside, a horizontal shaft arranged along a cylinder shaft of said bent plate a rotor in said compartment which can rotate around said horizontal shaft along said cylinder shaft and provided with a number of rotating edge knives regularly distributed over its circumference, said edge knives cooperating with two oppositely situated fixed edge knives arranged at both sides above said bent plate that when rotating, cutting edges of said rotating knives pass close by cutting edges of said fixed knives so that sufficiently reduced synthetic parts are pressed subsequently through holes in said perforated plate;

each of said chutes for glass and for tins including a plate press in each said chutes, said plate press comprising two parallel, vertical press plates, a first of which is fixed to a wall of said chute and a second of which is mobile towards and away from said first by means of a jack driven by a threaded shaft, said second plate being guided along two oppositely situated walls of said chute by means of a system of bearings and rollers, a closing plate just under said plate press adjacent and parallel to said fixed plate having a slot through which crushed glass or flattened tins can fall down.

2. The disposal installation according to claim 1, further characterized by each of said rotating grinders having a separate rotor shaft with said separate rotor shafts in line with each other and driven by said first mentioned common driving means.

* * * * *